US009260886B2

(12) United States Patent
Myers et al.

(10) Patent No.: US 9,260,886 B2
(45) **Date of Patent: *Feb. 16, 2016**

(54) ELECTRONIC CAM LOCKING SYSTEMS FOR VENDING MACHINES AND THE LIKE

(75) Inventors: Gary L. Myers, Monee, IL (US); Calin V. Roatis, Long Grove, IL (US); William D. Denison, Lake Zurich, IL (US); Thomasz Barnas, Lake in the Hills, IL (US); Catalin Captarencu, Wheeling, IL (US); Richard Paeth, St. Charles, IL (US)

(73) Assignee: TRITEQ LOCK AND SECURITY, LLC, Elk Grove, IL (US)

( * ) Notice: Subject to any disclaimer, the term of this patent is extended or adjusted under 35 U.S.C. 154(b) by 177 days.

This patent is subject to a terminal disclaimer.

(21) Appl. No.: 11/386,928

(22) Filed: Mar. 22, 2006

(65) Prior Publication Data

US 2006/0186678 A1 Aug. 24, 2006

Related U.S. Application Data

(63) Continuation-in-part of application No. 10/905,524, filed on Jan. 7, 2005, now abandoned, which is a continuation of application No. 10/345,864, filed on Jan. 16, 2003, now Pat. No. 6,874,828, which is a continuation of application No. 09/962,508, filed on Sep. 25, 2001, now Pat. No. 6,581,986.

(60) Provisional application No. 60/252,210, filed on Nov. 21, 2000.

(51) Int. Cl.

| | |
|---|---|
| ***E05C 5/02*** | (2006.01) |
| ***E05B 47/00*** | (2006.01) |
| ***E05B 17/00*** | (2006.01) |

(Continued)

(52) U.S. Cl.

CPC ..... *E05B 47/0012* (2013.01); *E05B 17/0029* (2013.01); *E05B 47/023* (2013.01); *E05B 47/026* (2013.01); *E05B 15/0205* (2013.01); *E05B 2047/0024* (2013.01); *E05B 2047/0069* (2013.01); *Y10T 292/699* (2015.04)

(58) Field of Classification Search

USPC ..... 292/341.16, 144, 57, 58; 70/275

See application file for complete search history.

(56) References Cited

U.S. PATENT DOCUMENTS

| | | | |
|---|---|---|---|
| 2,943,880 | A | 7/1960 | Joachim et al. |
| 3,089,330 | A | 5/1963 | Kerr |

(Continued)

*Primary Examiner* — Alyson M Merlino

(74) *Attorney, Agent, or Firm* — Miller, Matthias & Hull LLP

(57) ABSTRACT

An electronic locking system for vending machines or the like is provided for locking and unlocking the machine preferably with a remotely controlled electronic cam operating device. The lock system includes at least one axially and also preferably rotationally movable cam that can be mounted selectively on the cabinet or in the body of the machine and at least one slotted receiving device disposed either on the door or within the interior of the machine and positioned for engagement by the cam when the door is moved between an open position, an intermediate and closed position. When the door is manually moved from the open position to the intermediate closed position, the cam advances into the receiver slot and moves to draw in the door. The cam movement pulls the door into the closed position wherein a gasket disposed between the door and the vending machine is substantially uniformly compressed and sealed around its periphery. In one form a support is provided at the outboard end of the cam for added resistance against prying. The locking device may also be provided with a remote control unit which provides instructions to the electronic circuitry of the locking mechanism.

24 Claims, 14 Drawing Sheets

(51) Int. Cl.
*E05B 47/02* (2006.01)
*E05B 15/02* (2006.01)

(56) References Cited

U.S. PATENT DOCUMENTS

| | | | | | |
|---|---|---|---|---|---|
| 3,550,412 | A | | 12/1970 | Pitel et al. | |
| 3,854,310 | A | | 12/1974 | Paull et al. | |
| 3,947,060 | A | | 3/1976 | Zimmer et al. | |
| 4,167,104 | A | | 9/1979 | Bond | |
| 4,466,263 | A | * | 8/1984 | Rathmann | 70/264 |
| 4,552,001 | A | | 11/1985 | Roop | |
| 4,609,215 | A | | 9/1986 | Self et al. | |
| 4,702,095 | A | * | 10/1987 | Ben-Asher | 70/279.1 |
| 4,760,721 | A | | 8/1988 | Steinbach | |
| 4,762,348 | A | | 8/1988 | Matsumoto et al. | |
| 4,796,932 | A | * | 1/1989 | Tame | 292/112 |
| 4,803,460 | A | | 2/1989 | Rhee et al. | |
| 4,899,561 | A | | 2/1990 | Myers | |
| 4,993,247 | A | | 2/1991 | Minemura | |
| 5,054,300 | A | | 10/1991 | Nakahara et al. | |
| 5,272,894 | A | | 12/1993 | Stillwagon et al. | |
| 5,349,345 | A | | 9/1994 | Vanderschel | |
| 5,548,982 | A | | 8/1996 | Rawling | |
| 5,617,082 | A | | 4/1997 | Denison et al. | |
| 5,639,130 | A | * | 6/1997 | Rogers et al. | 292/216 |
| 5,656,867 | A | | 8/1997 | Kokubu et al. | |
| 5,660,065 | A | * | 8/1997 | Edlund | 70/58 |
| 5,680,783 | A | | 10/1997 | Kuroda et al. | |
| 5,793,122 | A | | 8/1998 | Dingwall | |
| 5,813,257 | A | * | 9/1998 | Claghorn et al. | 70/208 |
| 5,915,766 | A | | 6/1999 | Baumeister et al. | |
| 6,068,305 | A | * | 5/2000 | Myers et al. | 292/201 |
| 6,068,308 | A | | 5/2000 | Molzer | |
| 6,130,611 | A | | 10/2000 | Pellaton et al. | |
| 6,196,037 | B1 | | 3/2001 | Urschel et al. | |
| 6,281,516 | B1 | * | 8/2001 | Bacchi et al. | 250/559.29 |
| 6,341,448 | B1 | * | 1/2002 | Murray et al. | 49/280 |
| 6,345,522 | B1 | * | 2/2002 | Stillwagon et al. | 70/277 |
| 6,501,070 | B1 | * | 12/2002 | Bacchi et al. | 250/239 |
| 6,502,869 | B1 | * | 1/2003 | Rosenquist et al. | 292/59 |
| 6,564,600 | B1 | | 5/2003 | Davis | |
| 6,575,504 | B2 | | 6/2003 | Roatis et al. | |
| 6,581,986 | B2 | | 6/2003 | Roatis et al. | |
| 6,765,222 | B2 | * | 7/2004 | Bacchi et al. | 250/559.29 |
| 6,815,661 | B2 | * | 11/2004 | Bacchi et al. | 250/221 |
| 6,867,685 | B1 | | 3/2005 | Stillwagon | |
| 6,874,828 | B2 | | 4/2005 | Roatis et al. | |
| 6,896,470 | B1 | * | 5/2005 | Chen et al. | 414/411 |
| 7,191,624 | B2 | * | 3/2007 | Beylotte et al. | 70/257 |
| 2003/0127866 | A1 | | 7/2003 | Martinez et al. | |
| 2004/0154363 | A1 | | 8/2004 | Beylotte et al. | |
| 2005/0161953 | A1 | | 7/2005 | Roatis et al. | |

* cited by examiner

ELECTRONIC CAM LOCKING SYSTEMS FOR VENDING MACHINES AND THE LIKE

CROSS-REFERENCE TO RELATED APPLICATIONS

This application is a continuation-in-part of U.S. patent application Ser. No. 10/905,524, filed Jan. 7, 2005 now abandoned, which is a continuation of U.S. patent application Ser. No. 10/345,864, filed Jan. 16, 2003, now U.S. Pat. No. 6,874,828, incorporated herein by reference, which is a continuation of U.S. patent application Ser. No. 09/962,508, filed Sep. 25, 2001 (now U.S. Pat. No. 6,581,986), incorporated herein by reference, which is based on Disclosure Document No. 453,811, filed Mar. 26, 1999, entitled "Vending Cam Lock," incorporated herein by reference, and claims priority on U.S. Provisional Patent Application No. 60/252,210, filed Nov. 21, 2000, incorporated herein by reference. It is also related to U.S. Pat. No. 6,575,504 that descends from the aforesaid Provisional application.

FIELD OF THE INVENTION

The present invention relates generally to locking devices and, more particularly, to a cam locking system for vending machines and the like and a method for locking and unlocking the same.

BACKGROUND OF THE INVENTION

In various machines such as vending machines, food machines, candy machines, refrigerated drink machines, and the like, there is ordinarily provided a lock assembly to prevent unauthorized access to the contents thereof. For example, some vending machines are provided with a key-activated lock assembly such as a pop-out T-handle lock assembly which allows an authorized user to open the door of the vending machine with a properly-encoded key. Such T-handle lock assemblies are well known in the art, as evidenced by numerous patents including U.S. Pat. No. 3,089,330 (Kerr), U.S. Pat. No. 3,550,412 (Pitel et al.), U.S. Pat. No. 4,552,001 (Roop), U.S. Pat. No. 4,760,721 (Steinbach), U.S. Pat. No. 4,899,561 (Myers), and U.S. Pat. No. 5,548,982 (Rawling). With such lock assemblies, the door is initially closed in a loose manner to catch the locking components of the lock assembly. Next, the handle of the locking assembly is rotated to draw the door against the housing of the vending machine and to compress a seal between the door and the housing. Other, more modern, vending machines are provided with a keypad-activated lock assembly which permits the door of the vending machine to be opened when a predetermined access code or combination is entered into the keypad. The prior art, however, failed to provide a lock assembly which automatically pulls the door of a vending machine into a completely closed position against the housing and/or a lock assembly which utilizes a remotely controlled electronic latching mechanism to lock and unlock the door. More recently, however, as shown in U.S. Pat. No. 6,068,305 (Myers et al.) such a locking system was proposed. Further refinements, improvements and better, different and improved locking components and systems have been sought by users and manufacturers of the machines.

The now most commercially accepted electronic locking system marketed by applicants' assignee TriTeq Lock and Security, LLC. is disclosed and claimed in its aforementioned U.S. Pat. Nos. 6,874,828, 6,581,986, 6,575,504 and pending application Pub. No. US 2005/0161953. There, a motor driven bayonet locking system has a bayonet locking element that moves both in the transational and rotational axis and coacts with a stationary slotted plate by extending to enter the plate, rotating to create an interferance from being withdrawn and then retracting to pull in and lock the door.

Other approaches both prior and later which are not believed to have become commercially acceptable sought to employ different types of mechanical latches and undirectionally actions electronic drivers such as solenoids.

Bond U.S. Pat. No. 4,167,104 proposed use of screw posts going into a threaded opening with a solenoid operating latching bolt. Similarly, Stillwagon U.S. Pat. Nos. 6,867,685 and 6,525,644 did the same with a notched post latch.

Martinez Publication US 2003/0127866 proposes a motor driven rotary hook and u-bolt where the hook shape provides pull in cam action.

Beylotte et al. Pub. No. US 2004/0154363 sought to motor drive a threaded post into a threaded split nut as in prior mechanically operated T-handle vending machine locks. Beylotte et al. who proposed a motor driven cam hook an alternative embodiment.

U.S. Patent to Myers et al. (U.S. Pat. No. 6,068,308) is an earlier form of latch with a pull in function.

OBJECTS OF THE INVENTION

Accordingly, a general object of the present invention is to provide an improved locking system capable of even being a key-less electronic operated lock for vending machines and the like.

A related object of the present invention is to provide a cam-operated locking system and method for locking and unlocking vending machines or the like in a novel and secure manner.

An additional object of the present invention is to provide a cam-operated locking system having the foregoing characteristics which is more reliable, durable, economical and convenient to use.

SUMMARY OF THE INVENTION

An electro-mechanical cam-operated system having a function that facilitates specialized movements that can be utilized to secure and seal a variety of devices. The sealing action is being defined as a pulling motion of the primary mechanism. The locking action happens by virtue of a localized geometry that interfaces into an another specialized designed receiver device. The receiver device is generally mounted in a stationary manner. The localized geometrically designed element is called a cam for the purposes of this abstract. The cam design is not intended to be a single geometry element that unto itself is design critical to the operation concept of this mechanism. Alternate methodology may be used to facilitate the securing portion of the mechanism.

The cam is designed to operate perpendicular to the receiver in such a manner as to allow it to enter into the receiver by allowing the cam to have geometry that allows the cam to enter into it. After this is accomplished an electrical detection device sends a signal to an electrical control device. This device then sends a signal to a motor that in turn rotates a cylindrical device located about another cam. This cylindrical device has a unique geometry that interfaces with a central located tube type of device and a tubular type pin. The combined rotation causes the other cam to first rotate 90 degrees or thereabout. And then begin to wind its way up a spiral ramp located in a pocket of the cylindrical device. This cylindrical device also has two binary electrical devices that are strategically located to detect the relative position of the locking cam for both rotation and sealing (pull). This cylindrical device has a typical gear shape located on it outside diameter. This gears movement is derived from a worm gear interface that is driven by a motor. The motor derives its intelligence form the electrical controller.

A specific intelligence is embedded into the controller that facilitates several fault modes and operational parameter of the electromechanical system. This intelligence may be delineated as relay or software type of logic. The lock controller provides two specific functions.

Access control functions to ascertain the authorized user is accessing the locking device. Several access control methodologies may be utilized such as keypads with specific codes for entry, hand-held transceivers, electronic digital keys, transponders, etc.

Typical access control functions such as keypads, remote controls and electronic keys are taught in Denison U.S. Pat. No. 5,617,082, and Vanderschel U.S. Pat. No. 5,349,345. The locking device may utilize any such access control methodology that is appropriate for the application for the operator and the enclosure the lock is mounted to.

Lock motor control functions once the controller has determined the lock is authorized to change from the locked to unlocked state, or, authorized to change from the unlocked to locked state. The components required to accomplish the required motor control operation are the motor drive, cam, Receiver, Receiver Sensor, SW1 end of rotation sensor, SW2 30 degree Sensor, over-current sensor, and the CPU based controller.

The cylindrical device has a cover located about the opposite side of the area that causes the pin to wind it way on the ramp. This cover keeps the pin in a proper perpendicular path to the mechanisms securing motion.

The utilization of this device is providing simple easy access to devices that by necessity of application have a gasket or another means of sealing a door or the like. This would be described by what is common known as an automotive door. The door must be accelerated to a speed that can facilitate the compression of the gasket and then secure the door. Much like slamming of a car door. This device provides an alternate method of closing the door and pulling the gasket to a sealed condition. This device is also furthered in its invention by having methodology through electrical monitoring of the cam conditions to adjust the pressure on the door gasket or seal. This is accommodated either by electrical position devices or detecting the motor characteristics by the electrical controller. The automotive door is used to only describe the actions, which caused the necessity of this invention. Any device that has a requirement for securing and sealing is a possible application of this device.

Applications: Truck doors, Vending machine doors, Automotive doors, Refrigerator doors, Etc.

The cylindrical device with its associated motor and electrical detection devices are always mounted in a manner that separates them from the receiver unit. To further clarify this explanation consider the following sample concept, a car door has a rotary type securing device that is generally located in the door that secures its via a mechanical interface with a pin that is located in the frame of the vehicle. The cylindrical device would draw a similarity in its function as the rotary type device. The utility of this is to further the security by sealing the door after closing. Recalling that this device in its improvement into the market does not require massive forces to initiate the function of securing the cam. This means that the device the system is mounted to would inherently be subject to less stress and wear, thus extending its life.

While there are mechanisms in the public domain that facilitate total system functionality of the specific motion similar to that being described here. One of the unique attributes of this product design is its ability to absorb very high closing impact forces without subjecting the system or the mechanism its mounted to any impact damages. This system has shock absorbing devices located within the tube and positioned on the end of the cam. Such is this geometry that it does not deter from the adjustment function as an independent local event in the motion of pulling in. The cam in this system also serves to assist with alignment of the device it's attached to. By moving from the closed to the secure positions the cam has geometry which considers the perpendicularity into its motion and effectively cams it into the perpendicular position.

Also the other commercial systems which have similar motion to securing and sealing do not utilize the unique rotary motion of the cam used in this system.

This system replaces many devices in the public domain. Systems such a handles for vending machines. This system is designed to operate within the structure of the device it is securing. Therefore there is not external means by which to attack it. It may operate via an electrical controller that can utilize a variety of communication methods that are commercially available. These include but are not limited to Infrared, Radio frequency, and Switch keylock.

Because this design requires the application of an electrical signal to the motor to activate the system for both securing and opening sequence These activities can be monitored for later data collection. This data collection can be facilitated in many methodologies. This data then can serve the operator or owner for the purposes of detecting what key was used to gain access to the system.

One methodology which is being claimed a unique to this design is the ability to monitor the data through acquisition of the data with the remote initialization device. Typically known as a key, Key FOB of remote control. While this data collection is not primary to the system function. It acts to enhance the product to the market place.

US Reference:

U.S. Pat. No. 6,068,305 Fort Lock

U.S. Pat. No. 4,993,247 Sampo Lock

U.S. Pat. No. 5,272,894 Star Lock

Fort Lock U.S. Pat. No. 6,068,305 shows a type of system that pulls in. The pulling forces are transmitted through a rotor type latch. This system differs in that it uses a local designed cam that interfaces with a special receiver unit. Sampo U.S. Pat. No. 4,993,247 cites a slip nut arrangement. And U.S. Pat. No. 5,272,894 Star lock shows a retrofit design that eliminates the lazy action but still require manual input.

BRIEF DESCRIPTION OF THE SEVERAL VIEWS OF THE DRAWING(S)

Figure 5B:
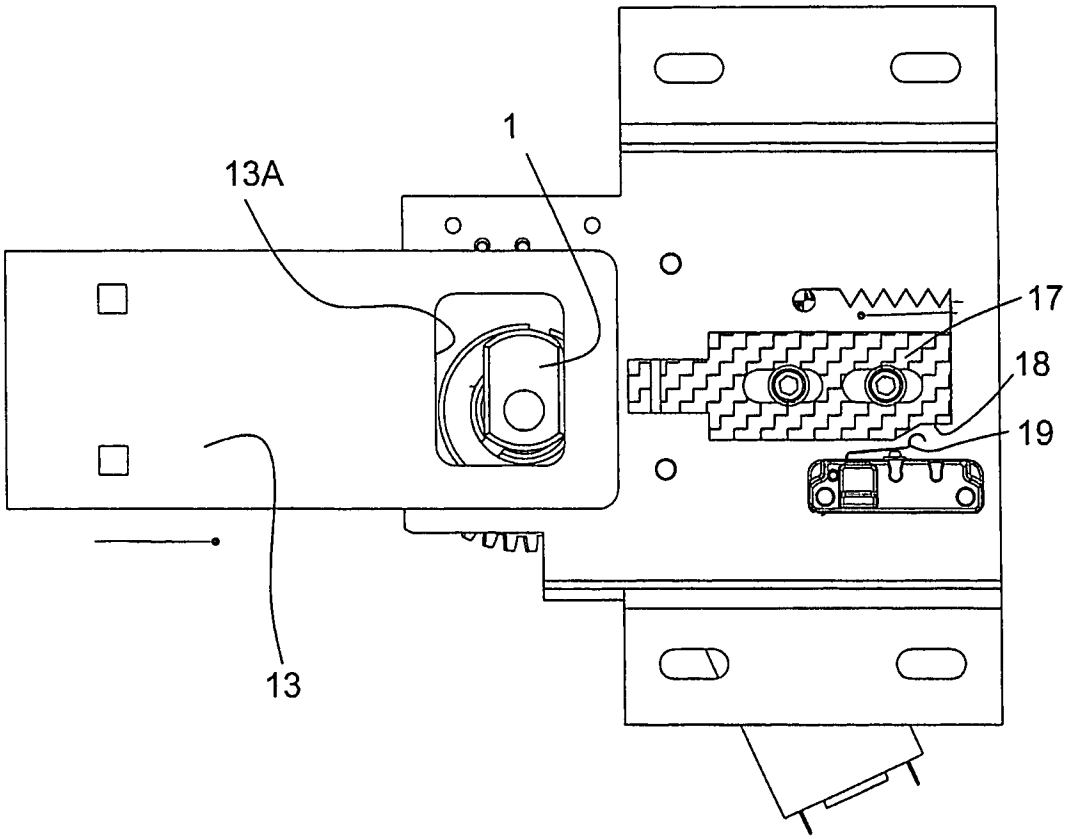
Figure 5A:
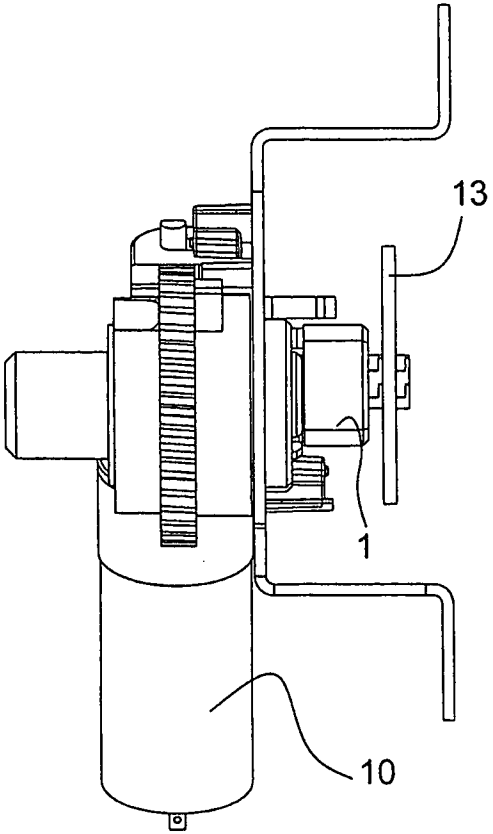
Figure 6B:
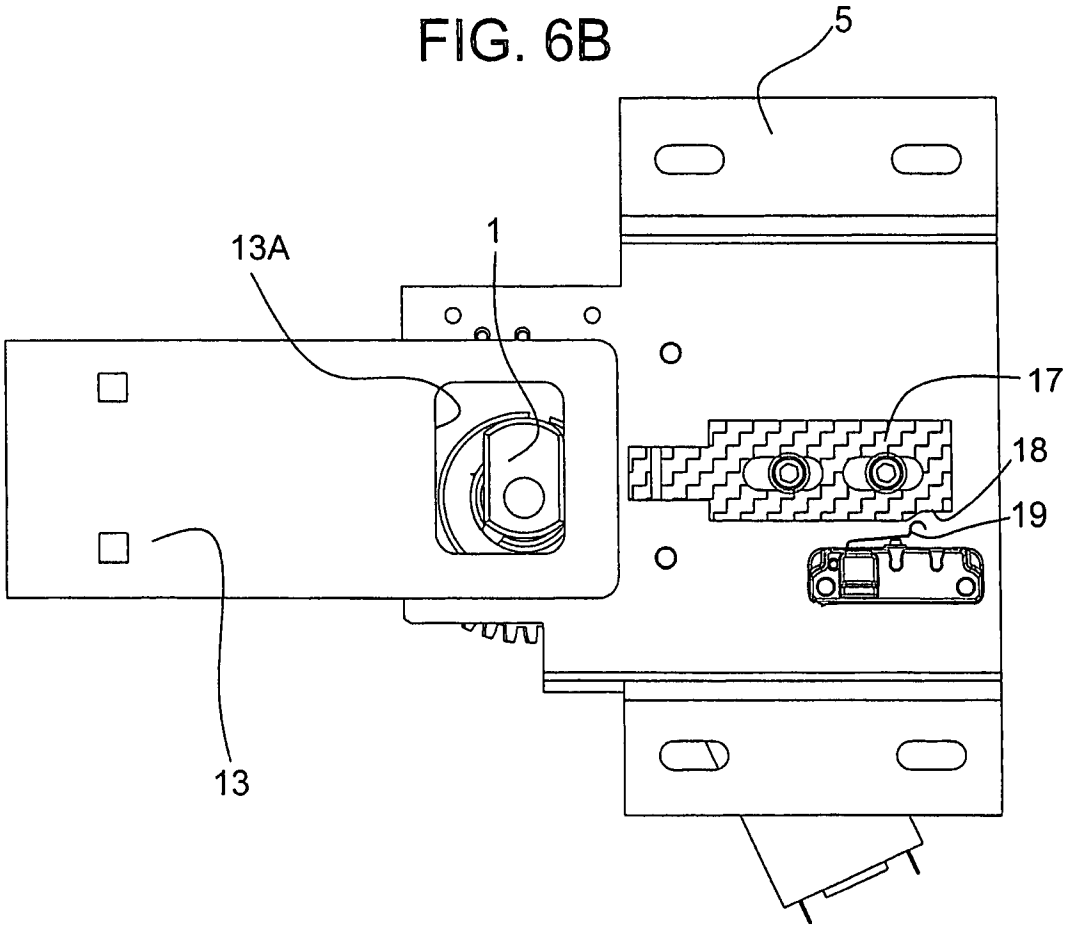
Figure 6A:
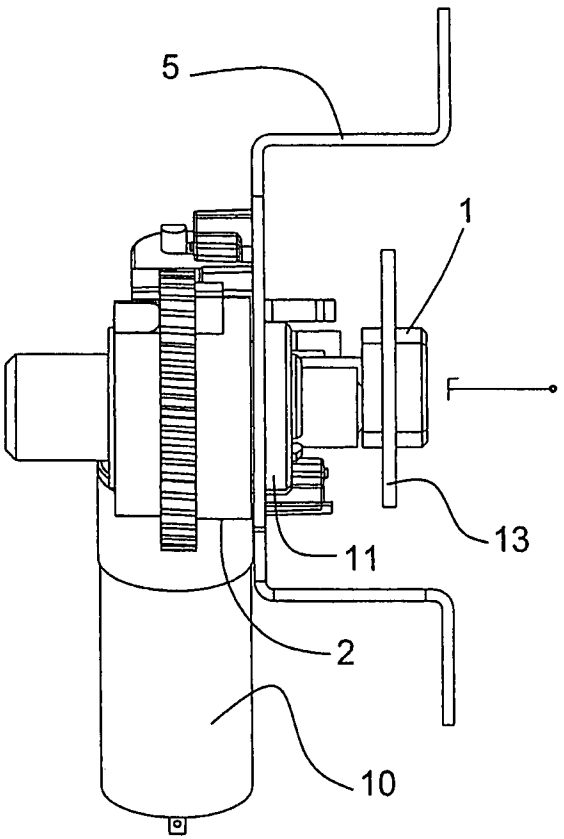
Figure 7B:
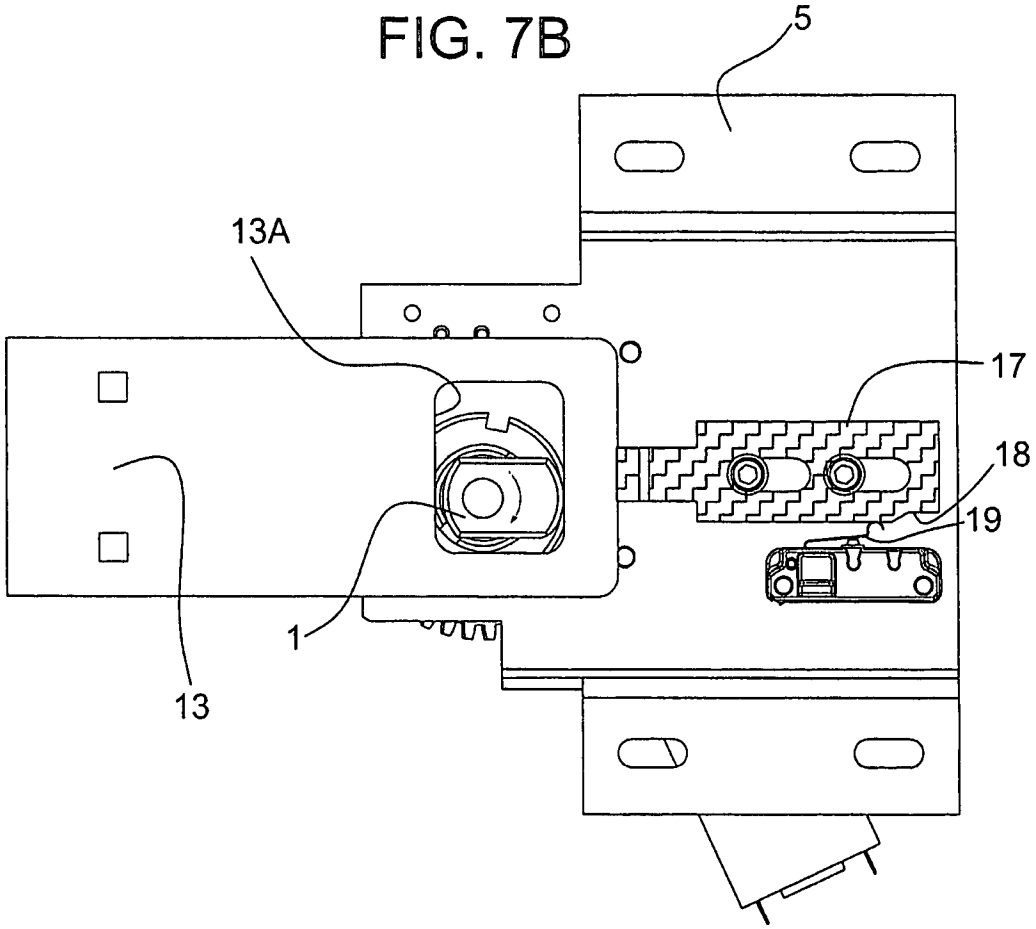
Figure 7A:
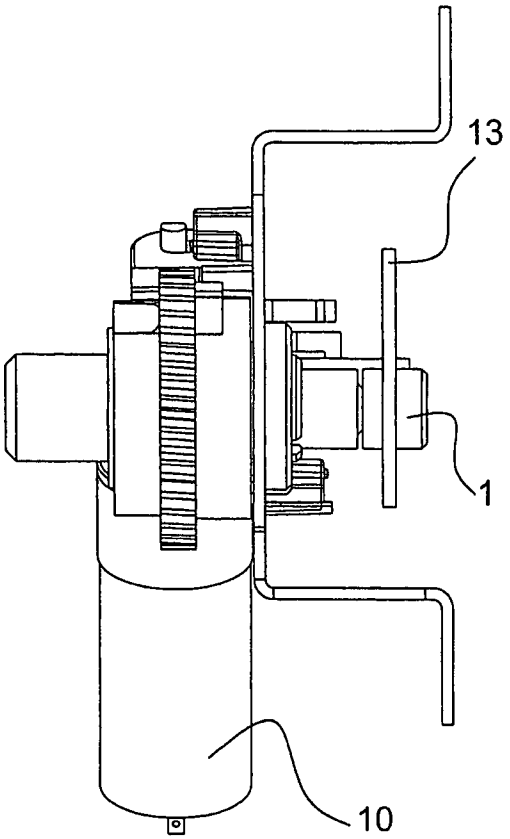
Figure 8B:
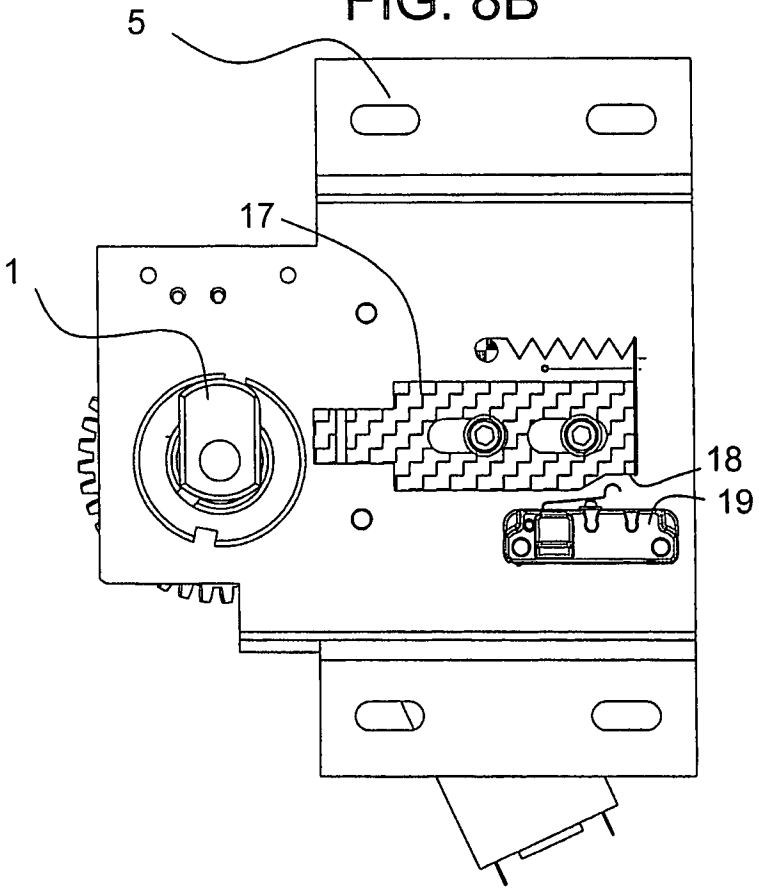
Figure 8A:
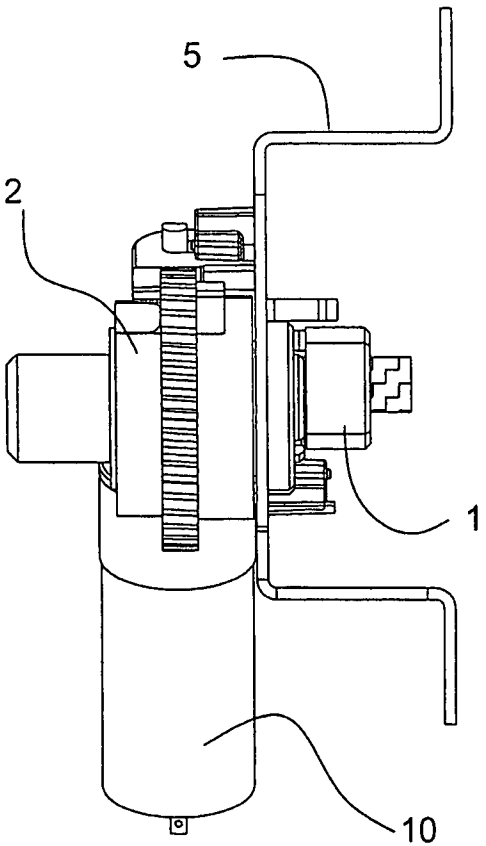
Figure 9B:
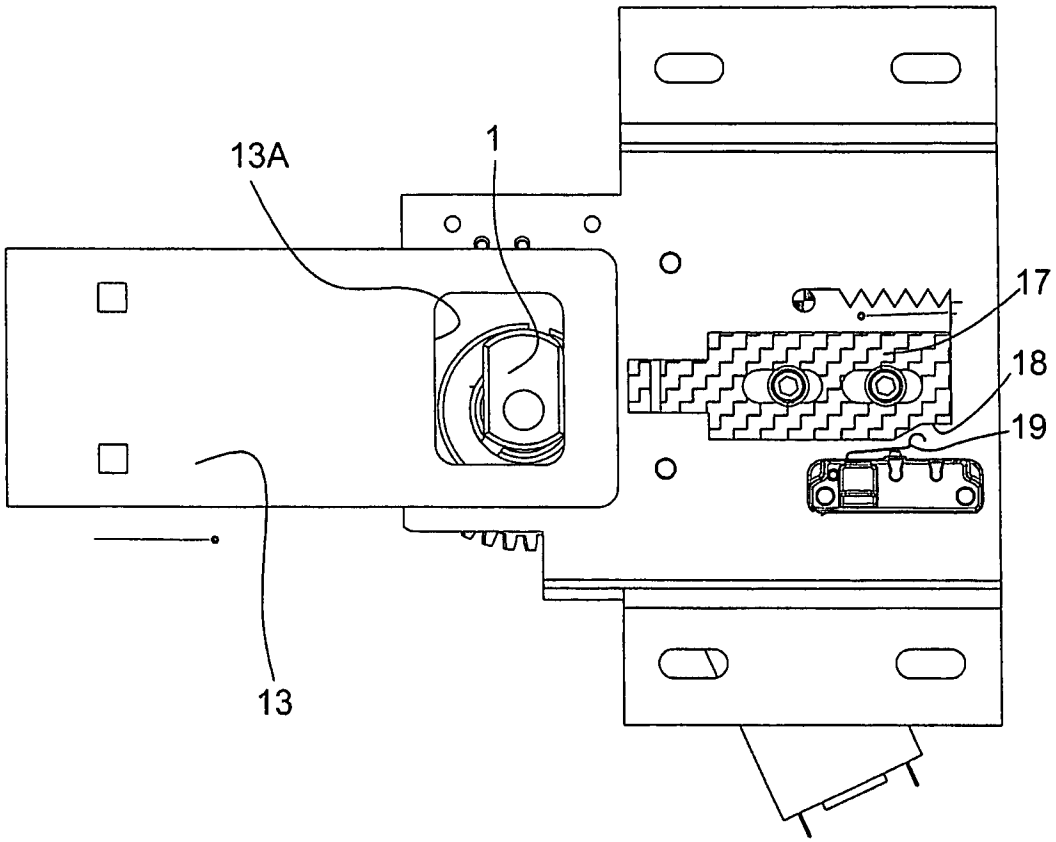
Figure 9A:
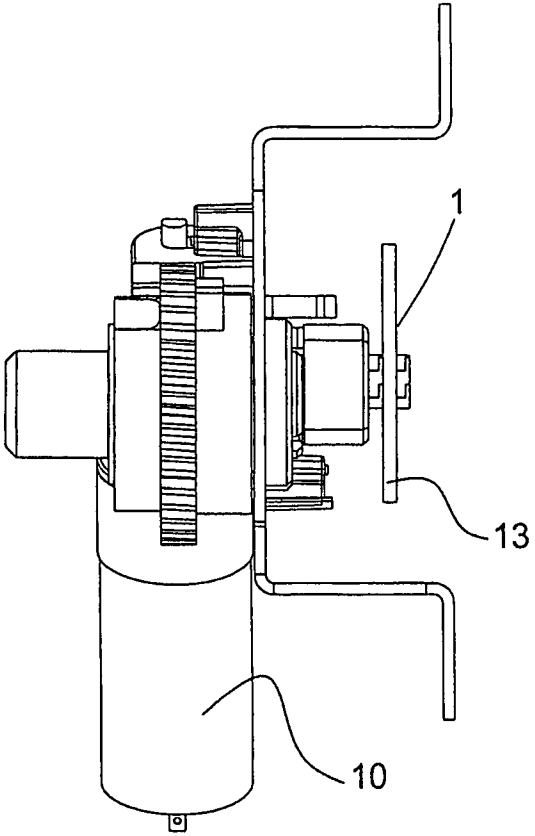
Figure 11:
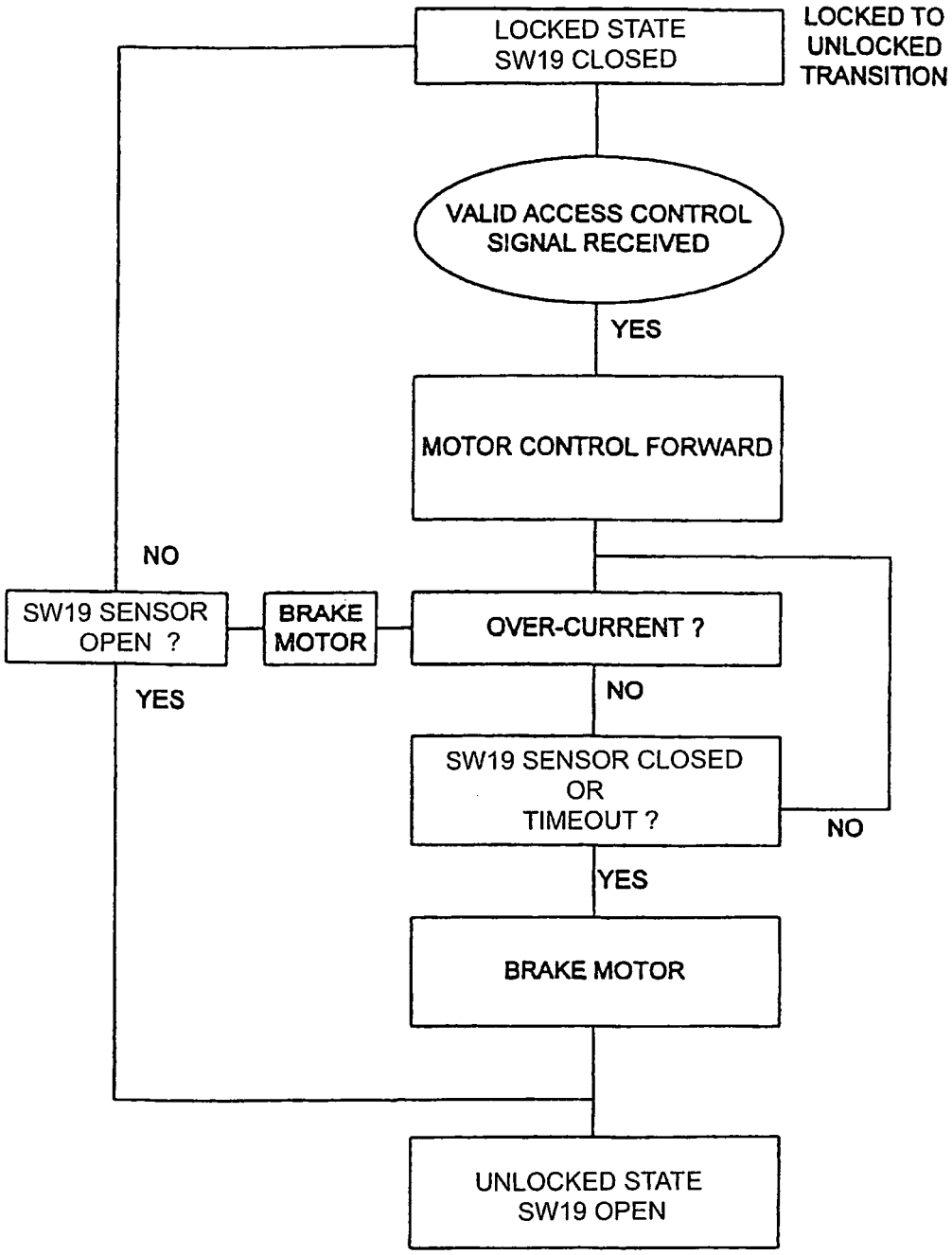
Figure 12:
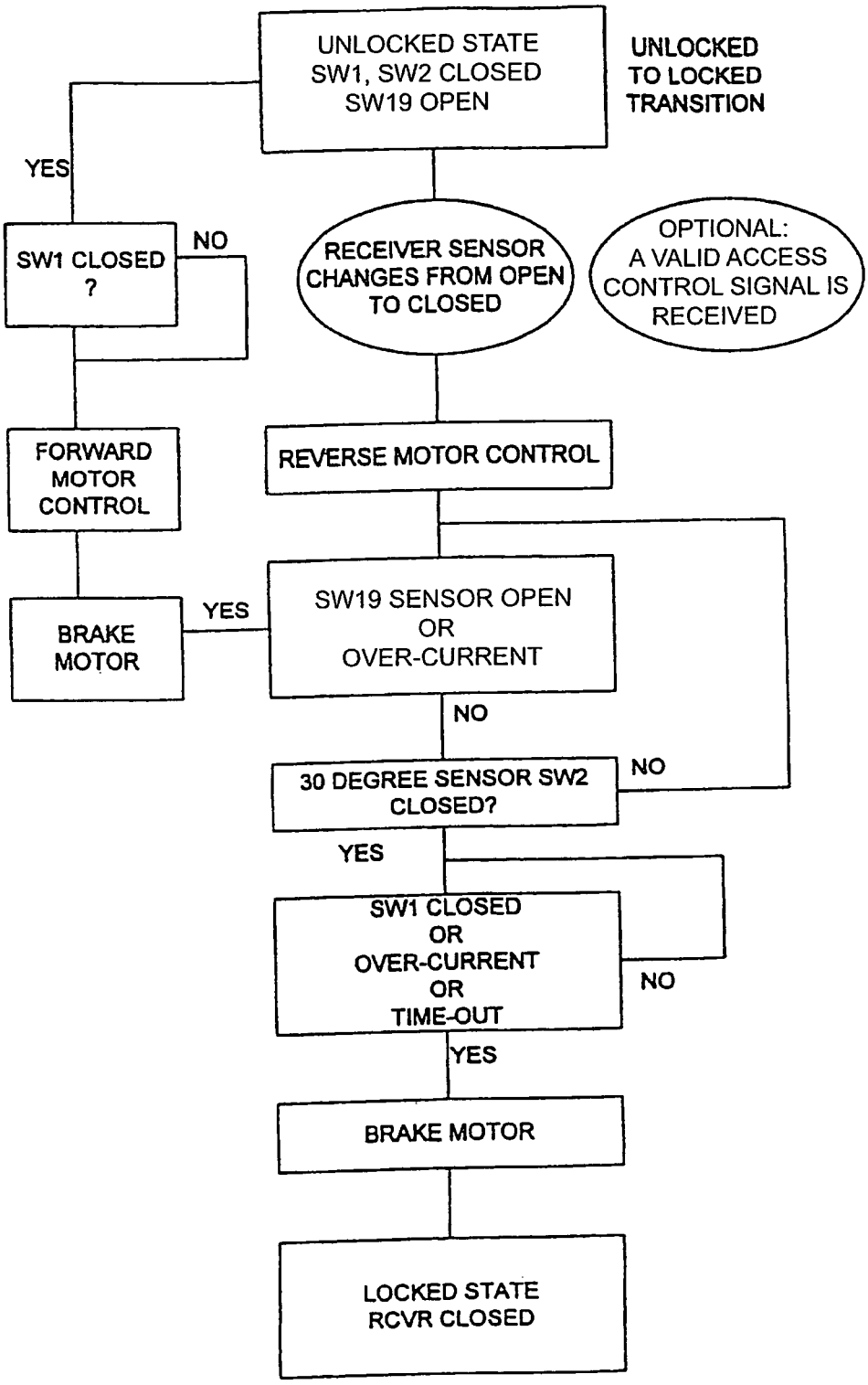
Figure 13:
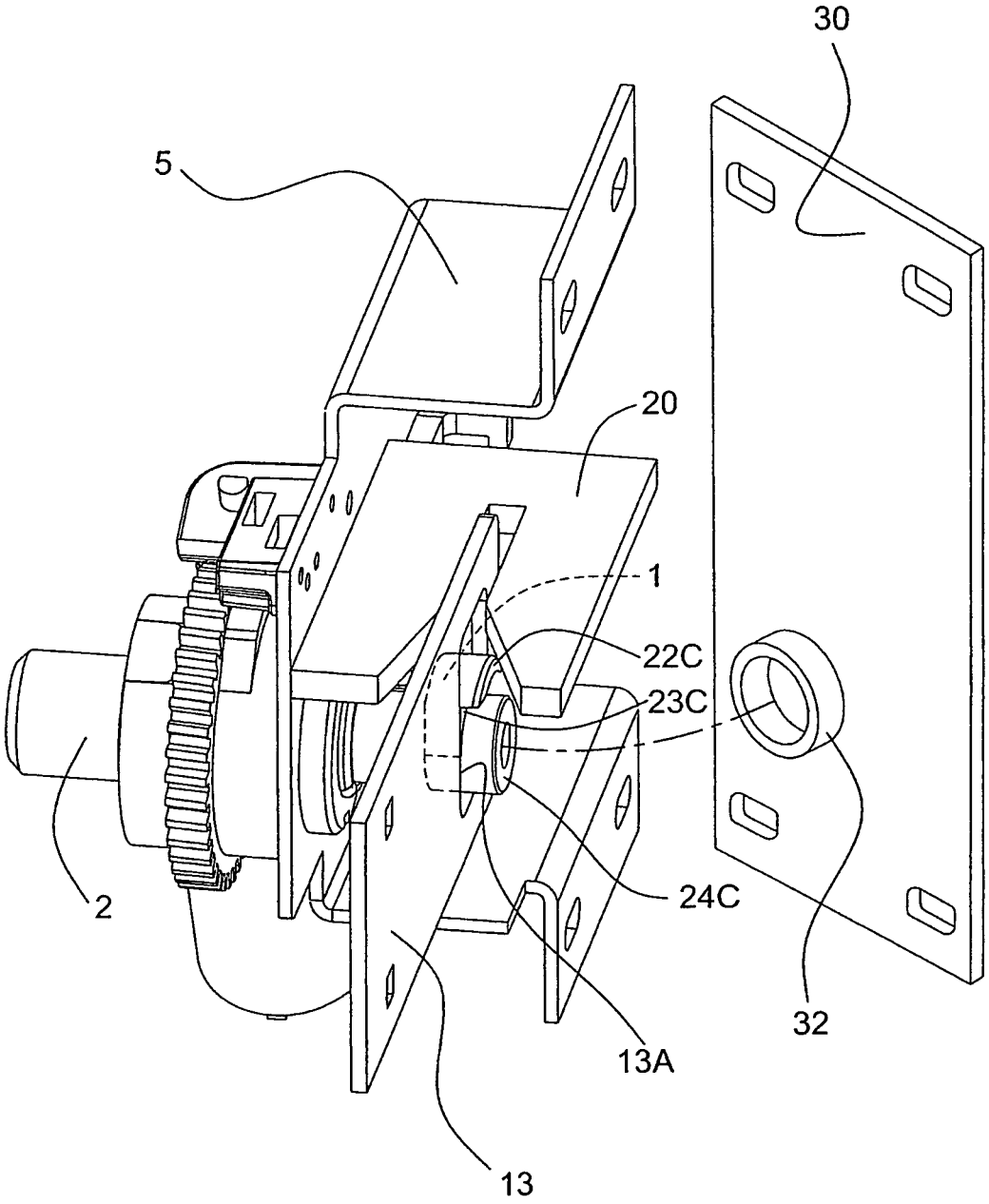
Figure 14:
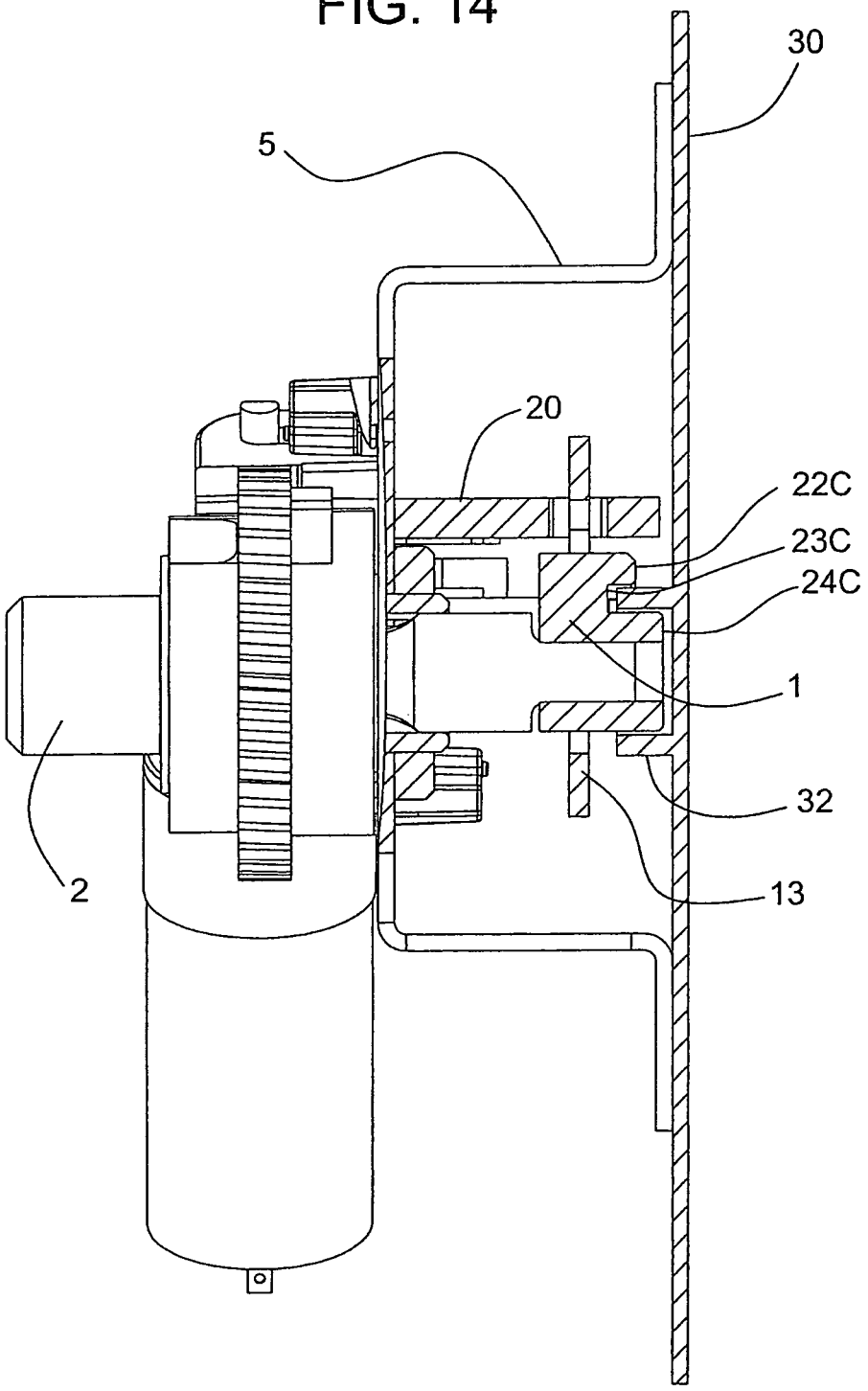

FIGS. 5A and 5B respectively are plan views showing the beginning secure functions for the cam and receiver;

FIGS. 6A and 6B are plan views showing the advancements of the cam into the receiver;

FIGS. 7A and 7B are plan views of the system showing rotational locking and drawing in by the cam;

FIGS. 8A and 8B are plan views showing the cam locking unit in its unlocked position without the receiver;

FIGS. 9A and 9B are plan views like FIGS. 8A and 8B with the receiver;

FIGS. 10A to 10F are perspective views of alternative cam designs useful with the electronic lock;

FIGS. 11 and 12 are flow charts showing respective lock and unlock sequences of operation;

FIG. 13 is a perspective, partially exploded view of a modified form of a receiver and cam operator; and FIG. 14 is a plan view partially in section of the operating lock of FIG. 13 in a locked portion.

In consideration of the electrical functions of the system the following description applies to the controller utilized. This controller features unique combination of sensing and control that differentiate it from controllers used in the public domain.

DETAILED DESCRIPTION OF THE INVENTION

Locked to Unlocked:

For specific details of the electronic control operation, reference may be made to our co-pending application publication Jul. 28, 2005 as US 2005/0161953 A1. In controlling the motor to change the state of the lock from locked to unlocked, the controller must first receive a valid access control signal from the operator (via a secure access control input means such as a keypad or hand-held transmitter) and shall proceed to energize the motor in the forward direction. The controller will wait for a position feedback indicator which is measured by a controller CPU to determine the lock has landed in the unlocked state. If this sensor is closed, the controller will proceed to break and de-energize the motor. In case the sensor is failed, the controller uses a motor current feedback signal to detect end of worm gear travel by sensing a stall motor condition and to de-energize the motor. In case both sensors fail, the controller will discontinue operation based on elapsed time.

In the case an over-current signal is received, the controller must determine if this signal is a function of a jammed cam with the lock still in the locked state, or if this signal is a function of the worm gear reaching the unlocked state and the sensor failed. In the case of a jam, the receiver sensor is expected to be closed and the condition is still locked. Thus, the controller will proceed to assume a locked condition. In the case the receiver sensor is open, it as assumed that the cam has unseated from the receiver and the lock is unlocked. Thus, the controller will proceed to the unlocked state.

Figure 2:
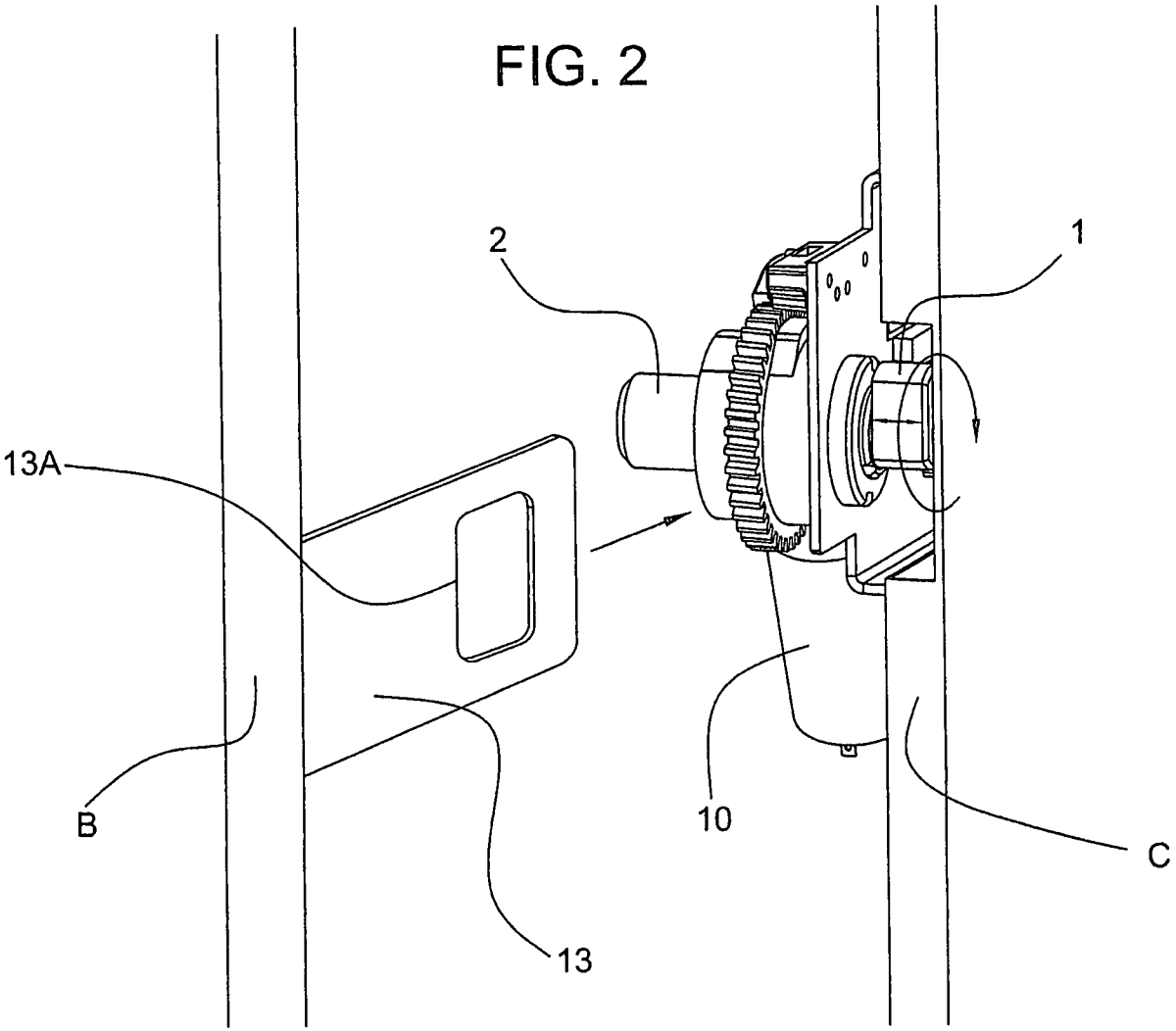
FIG. 2 is an enlarged perspective view of the system with the door mounted received and cabinet mounted cam operating lock.

Unlocked to Locked:

In controlling the motor, FIG. 2, item 10 to change the state of the lock from unlocked to locked, the controller shall wait to receive a valid lock signal from the operator. This signal shall at a minimum be a sensor signal received by the controller whether the cam, FIG. 2, item 1 is positioned to be seated in the receiver.

Figure 3:
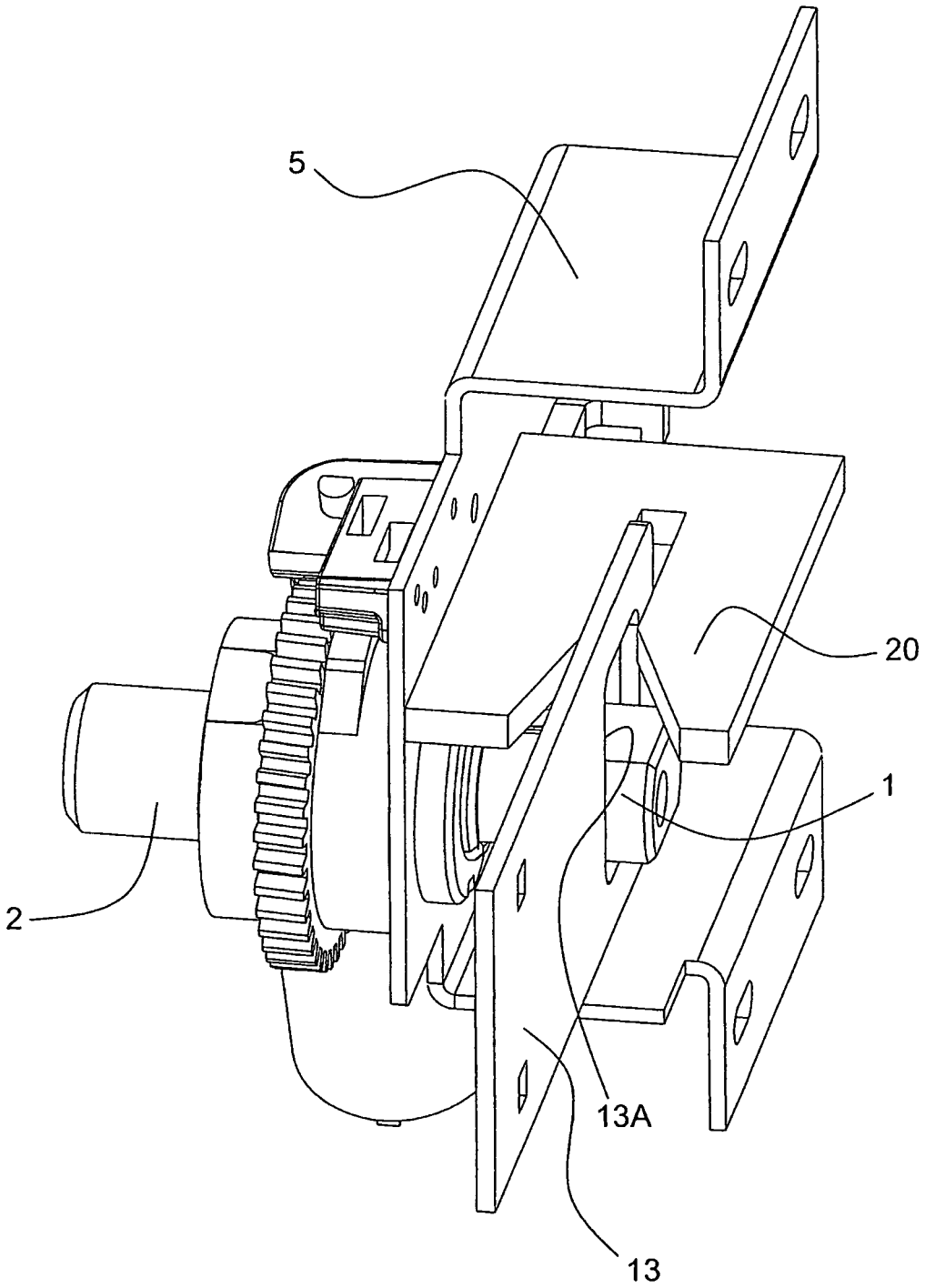
FIG. 3 is an enlarged perspective view of the receiver and cam operator in a locked position free of the door and cabinet.
Figure 4:
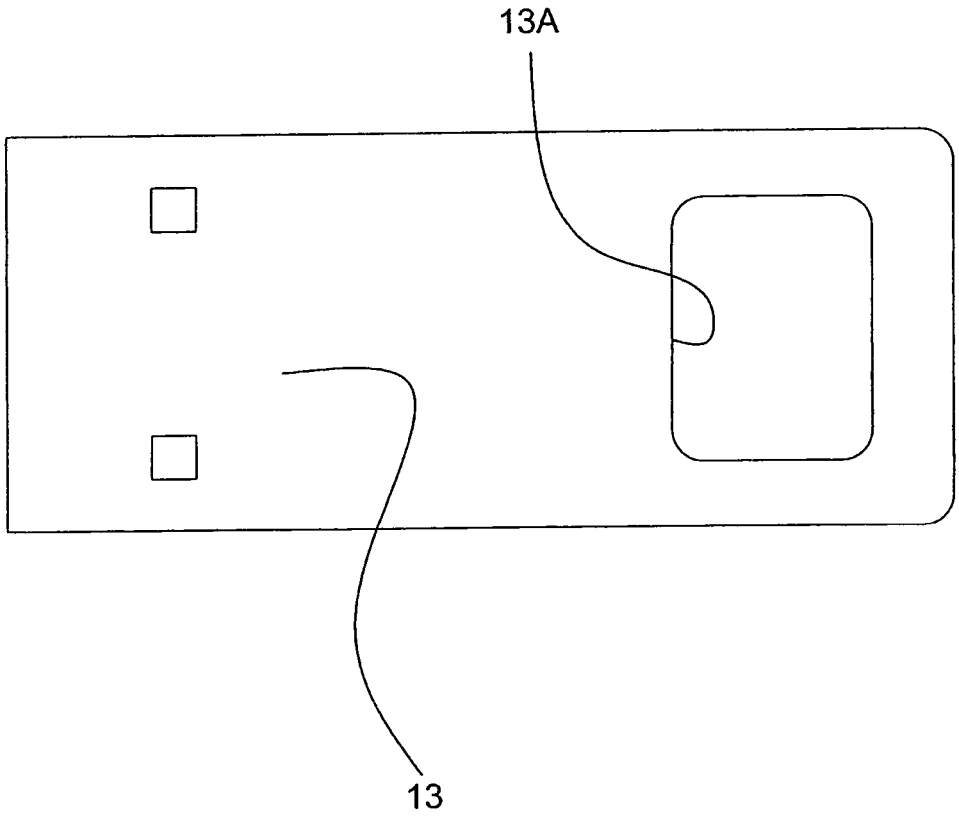
FIG. 4 is a plan view of the receiver.

The receiver 13 sensor FIG. 4 is a plate like a member with a slot opening 13A preferably mounted to door B (FIG. 1), which is open when the lock is unlocked In FIGS. 2 and 3 there is shown the sequence of closing and locking a vending machine door in accordance with the present electronic cam lock system, Door B carrying the receiver 13 with slot opening 13A is moved toward the cabinet C which here carries the cylinder driven unit 2 which operates the cam element 1. In FIG. 3, the plate receiver have been guided in place by a Y slot guide 20, the motor drive has a advanced the cam 1 into the slot 13A and the unit 2 is ready for rotation of the cam 1.

As seen in FIG. 5, the receiver 13 will engage a spring held side 17 that can be moved horizontally to sense the positioning of the receiver with respect to the retracted or unlock position of the cam 1. The slide 17 has a sloped notch area 18 which operates sensor switch 19 to provide the signals for when the locking and unlocking actions can be operated by a controller and the motor drive unit. When the cam 1 is in position and the sensor switch allows the motor drive to operate, FIGS. 5 and 5A, the cam 1 is advanced longitudinally as shown in FIGS. 6A and 6B so that receiver 13 is captured and the door is held closed. Referring to FIGS. 7A and 7B the cam 1 is rotated within slot 13A and the result is that a door carrying receiver 13 would be pulled in. The drive motor 10 rotates the cam 1 in the receiver and pulls in the door until the sensor signals the cam position for the controller to stop the motor. During locking if switch 19 senses that the receiver has moved back out of position before the cam 1 enters the slot the motor is reversed and the unlock position is maintained until the next cycle.

Figure 1:
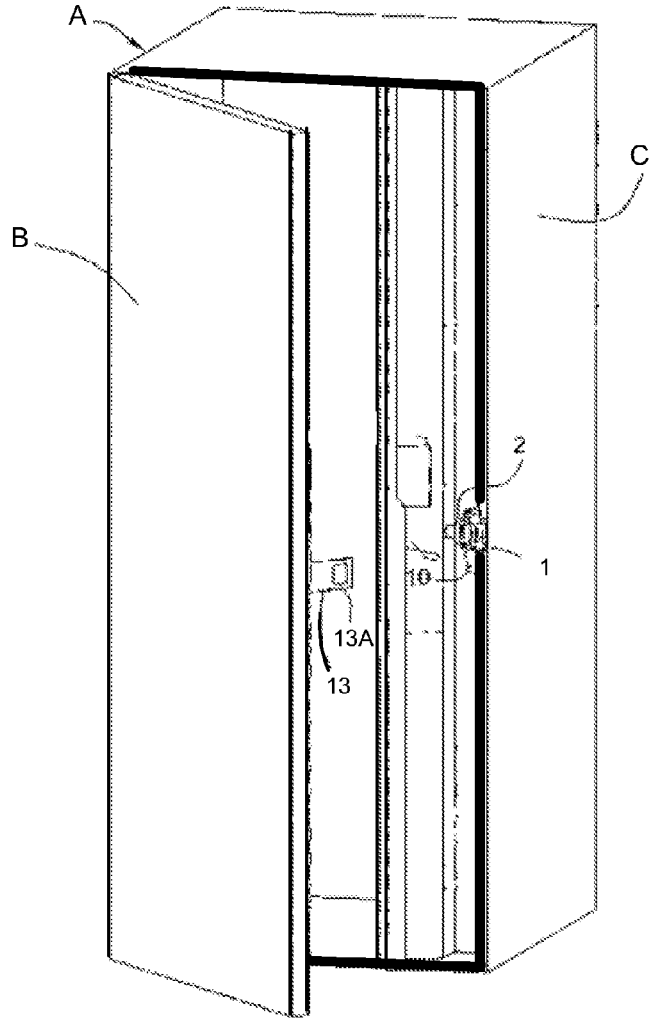
FIG. 1 is a perspective view of an illustrative vending type machine A with a door B and cabinet C in a partially open position showing the locking devices.
Figure 1A:
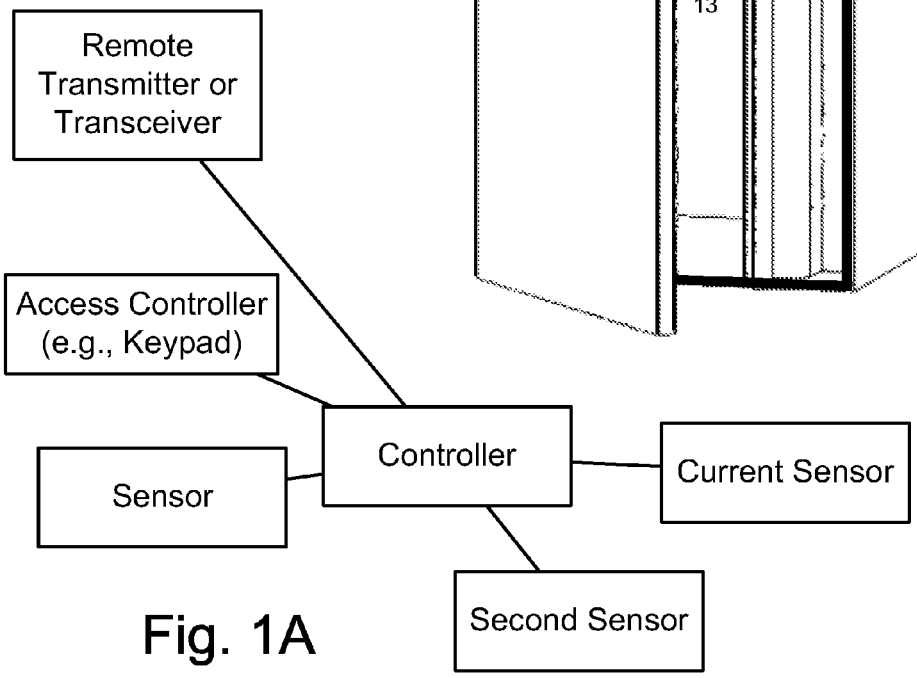
FIG. 1A is a simplified block diagram showing a controller, sensor, access controller, keypad, remote transmitter, remote transceiver, second sensor and current sensor in accordance with an embodiment of the disclosed principles.

In FIGS. 8A and 8B, the cam 1 driving unit 2 and its components are shown as mounted to a bracket 5 which is easily attachable to a cabinet as in FIGS. 1 and 2. The cam element 1 is shown in the retracted and unlock positions.

Figure 10A:
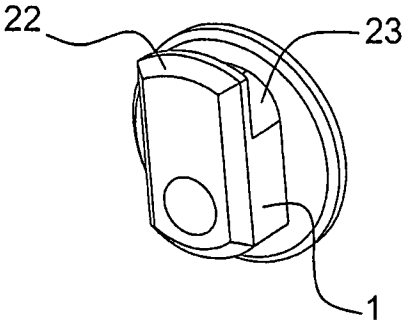
Figure 10B:
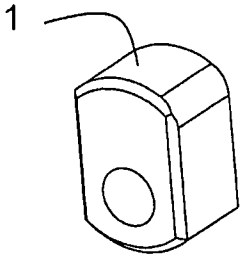

Referring to FIGS. 10A-F, there is shown various alternative cam 1 elements which can be used with the present locking system. FIG. 10B shows the same cam as in the previous FIGS. 1-9, and it is preferably used with a guide 20 as shown in FIG. 3.

FIG. 10A shows a notched element 1 with a raised lip 22 and notched 23 which would coact with receiver 13, slot 13A for a self guidance action. It is similar to the bayonet catch action of applicants' referenced patents.

Figure 10C:
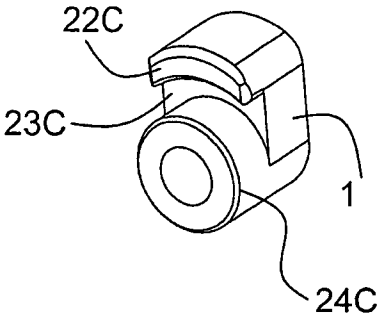

FIG. 10C shows another notched form with a notch 23C and a horizontal lip 22C. This form provides a tip 24C to guide the cam into slot 13A.

Figure 10D:
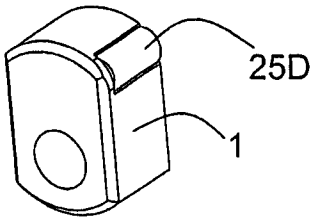
Figure 10E:
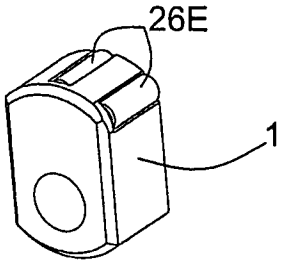
Figure 10F:
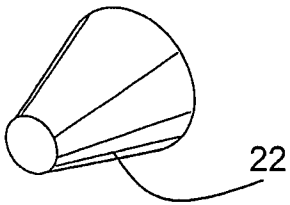

FIG. 10D shows a cam form with a single roller 25D and FIG. 10E shows a double roller 26B for smoother transitions and increased cam life in more demanding and heavy duty applications, respectively. FIG. 10F shows a shaped cam 28 that is generally conical. It will enter the receiver slot and provide pull in with the longitudinal movement of the driving unit and rotation is unnecessary to its operation. Rollers, not shown, can be carried by the receiver or the conical shaped cam to reduce wear and friction.

Flow charts FIG. 11 and FIG. 12, respectively indicate the lock to locked events and vise versa. The sensor switch 19 which is operated by slide 17 that determines the position and absence of the receiver 13 provides the requisite signals for the controller to operate the motor 10.

Referring to FIGS. 13 and 14 there is shown a locking system like the one discussed with respect to FIG. 3, for example, but with additional support means for the outboard end of the cam when in the extended portion. This provides additional strength against attempted prying open of the door.

In accordance with the present aspect of the invention, the cam 1 is preferably like that in FIG. 10C. A plate member 30 that can be affixed along wall bracket 5, carries a bushing means 32 into which the extended portion 24*c* of cam 1 fits and provides strengthened support of the cam outboard end.

The present invention can be used with an axially rotatable pin with a finned end here not shown on the door B. The pin upon rotation when the door is closed catches one of the fins against a bracket, here not shown on the cabinet C. Placement of at least one of such pin and bracket arrangements prevents prying of the door at a corner. With the cam locking means adjacent an opposite corner, both door opening corners are protected.

What is claimed is:

1. A locking system for a door movable between open and closed positions relative to a stationary body, comprising: a cam shaft, having a longitudinal axis and a shaped end, the cam shaft being carried by a first one of the door and the stationary body, the cam shaft being rotatable about its longitudinal axis and, independent of such rotation, also being translatable along the same axis relative to the first one of the door and the stationary body; a receiver, carried by a second one of the door and the stationary body, the receiver being adapted to be engaged by the shaped end of the cam shaft; and a motor configured to lock the door to the stationary body by (1) extending the cam shaft axially into the receiver without rotational motion of the cam shaft, thus interferingly engaging the shaped end of the cam shaft with the receiver, (2) rotating the cam shaft without axial movement of the cam shaft, thus drawing the closed door and the stationary body together, the motor being further configured to unlock the door from the stationary body by (1) rotating the cam shaft without axial movement thereof, thus releasing the closed door from the stationary body, and (2) axially withdrawing the cam shaft toward the first one of the door and the stationary body to disengage the shaped end of the cam shaft from the receiver.

2. A locking system as claimed in claim 1 wherein at least one of said moveable door and stationary body carries a flexible peripheral gasket and drawing of the cam shaft together with the receiver causes said gasket to compressively seal the area between the door and the stationary body.

3. A locking system as claimed in claim 1 wherein said cam shaft and said motor are carried within the stationary body.

4. A locking system as claimed in claim 1, including: a position sensor for sensing the relative position of the receiver in respect to said cam shaft; and controlling means connected to said motor and said position sensor for controlling the actuation of the rotation and translation of said shaped end of the cam shaft to position the shaped end within and remove the shaped end from said receiver.

5. A locking system as claimed in claim 1, including:

a position sensor for sensing the longitudinal position of said cam shaft; and controlling means connected to said motor and said position sensor for controlling the actuation of said shaped end of the cam shaft to move the shaped end within and retract the shaped end from said receiver.

6. A locking system as claimed in claim 5, wherein said controlling means is connected to a current sensing means for controlling the actuation of said shaped end of the cam shaft to rotate the shaped end within and move the shaped end from said receiver.

7. The locking system of claim 1 wherein the shaped end further comprises a roller for applying a force to draw the door to the stationary body.

8. A locking system for locking a door movable between open and closed positions relative to a stationary body, comprising: a cam shaft, including a longitudinal axis and a shaped end, carried by a first one of said door and stationary body; said cam shaft shaped end being rotatable about the longitudinal axis; a receiver carried by a second one of the door and stationary body adapted to be engaged by the shaped end of said cam shaft; a motor rotating the shaped end of the cam shaft about the longitudinal axis without axial movement of the cam shaft when engaged with the receiver to draw the closed door and the stationary body together; an access control means for receiving an access control input; and a controlling means connected to said motor and said access control means for controlling the actuation of said shaped end of the cam shaft to move said shaped end in a direction parallel to the longitudinal axis and into engagement with said receiver without rotational movement of the cam shaft, and release the shaped end from said receiver.

9. A locking system as claimed in claim 8, wherein said access control means is a keypad.

10. A locking system as claimed in claim 8, wherein said access control means is a remote transmitter.

11. A locking system as claimed in claim 8, wherein said access control means is a remote transceiver.

12. A locking system as claimed in claim 8, including first sensing means for determining the relative position of said shaped end and the receiver and second sensing means for monitoring actuation of said controlling means.

13. A locking system for locking a door moveable between open and closed positions relative to a stationary body, comprising: a cam shaft, including a longitudinal axis and a shaped end, carried by a first one of the door and stationary body; said shaped end of the cam shaft being rotatable about the longitudinal axis; a receiver carried by a second one of the door and stationary body adapted to be engaged by the shaped end of said cam shaft when the door is in the closed position; a motor advancing said cam shaft in a first direction parallel to the longitudinal axis and toward said receiver without rotational movement of the shaped end in response to closure of the door and retracting said cam shaft in a second direction, opposite to the first direction and parallel to the longitudinal axis, and away from said receiver without rotational movement of the shaped end, and the motor advancing and retracting the cam shaft in the first and second directions parallel to the longitudinal axis to move the shaped end of the cam shaft into engagement with the receiver to lock the door and to remove the shaped end of the cam shaft from engagement with the receiver to unlock the door; said motor advancing the cam shaft in the first direction parallel to the longitudinal axis to engage the shaped end of the cam shaft with the receiver in response to closure of the door, rotating the shaped end of the cam shaft without advancement or retraction of the cam shaft in the first and second directions parallel to the longitudinal axis to draw the door and stationary body together, and retracting the cam shaft in the second direction parallel to the longitudinal axis to release the shaped end of the cam shaft from the receiver to unlock the door.

14. A locking system for locking a door movable between open and closed positions relative to a stationary body, comprising: a cam shaft, including a longitudinal axis and a shaped end, carried by a first one of said door and stationary body; said cam shaft shaped end being rotatable about the longitudinal axis; a receiver carried by a second one of the door and stationary body adapted to be engaged by the shaped end of said cam shaft; a motor advancing the cam shaft in a first direction parallel to the longitudinal axis such that the shaped end engages with the receiver and then rotating the shaped end of the cam shaft about the longitudinal axis without movement of the cam shaft in the first direction parallel to the longitudinal axis and a second direction opposite to the first direction and parallel to the longitudinal axis so as to draw the door and the stationary body together; a position sensing means for sensing the position of said shaped end; and a controlling means connected to said motor and said position sensing means for controlling the actuation of said shaped end of the cam shaft to drive said shaped end into engagement with and removal from said receiver.

15. A locking system for locking a door movable between open and closed positions relative to a stationary body, comprising: a cam shaft, including a longitudinal axis and a shaped end, carried by a first one of said door and stationary body; said cam shaft shaped end being rotatable about the longitudinal axis; a receiver carried by a second one of the door and stationary body adapted to be engaged by the shaped end of said cam shaft; a motor moving the shaped end of the cam shaft in a first direction parallel to the longitudinal axis without rotational movement of the cam shaft to move the shaped end into engagement with the receiver in response to closure of the door to lock the door, rotating the shaped end without movement of the cam shaft in the first direction parallel to the longitudinal axis and a second direction opposite to the first direction and parallel to the longitudinal axis to draw the door and the stationary body together, and removing the shaped end from engagement with the receiver in the second direction parallel to the longitudinal axis to unlock the door; a position sensing means for sensing the longitudinal position of said cam shaft relative to said receiver; an access control means for receiving an access control input; and a controlling means connected to said motor, said access control means, and said position sensing means for controlling the actuation of said shaped end of the cam shaft to move the shaped end into engagement with and remove the shaped end from engagement with said receiver.

16. A locking device for locking a door movable between open and closed positions relative to a stationary body, comprising: a cam shaft, including a longitudinal axis and a shaped end, carried by a first one of the door and stationary body and adapted to move about and along the longitudinal axis; a slotted receiver carried by a second one of the door and stationary body and adapted to receive the shaped end of said cam shaft when the door is in the closed position; a motor advancing said cam shaft in a first direction parallel to the longitudinal axis without rotation of the cam shaft, toward and into engagement with said receiver in response to closure of the door to lock the door and retracting said cam shaft in a second direction opposite the first direction, parallel to the longitudinal axis, and away from said receiver to unlock the door; and said motor being drivable to rotate the shaped end of the cam shaft about the longitudinal axis without movement of the cam shaft in the first and second directions parallel to the longitudinal axis to draw the door and stationary body together.

17. A locking device as claimed in claim 16 wherein either said moveable door or stationary body carries a flexible peripheral gasket and said drawing of the cam shaft together with the receiver causes said gasket to compressively seal the area between the door and the stationary body.

18. A locking device as claimed in claim 16 wherein said receiver is a vertically oriented slot.

19. A locking device as claimed in claim 16 wherein said cam shaft and said motor are carried with the stationary body.

20. The locking system of claim 16 wherein the shaped end further comprises a roller for applying a force to draw the door to the stationary body.

21. A locking system for locking a door moveable between open and closed positions relative to a stationary body, comprising: a receiver on one of the door and the stationary body; a cam shaft having a shaped end capable of longitudinal and rotational movement relative to a longitudinal axis of the cam shaft on the other of the door and the stationary body; a motor connected by at least one gear to said cam shaft for locking and unlocking the door; a controller that operates the motor wherein: the door is unlocked upon the controller receiving an access control signal during an unlocking process; the door is locked via the controller in response to closure of the door whereby the shaped end of the cam shaft is advanced by the motor to move longitudinally parallel to the longitudinal axis from an unlocked position to a locked position without rotation of the cam shaft so as to engage with the receiver, and the cam shaft is further rotated without longitudinal movement of the shaped end of the cam shaft parallel to the longitudinal axis such that the door is drawn toward the stationary body.

22. The locking system of claim 21 wherein the shaped end further comprises a roller for applying a radial force to the door or stationary body.

23. The locking system of claim 21 wherein the motor discontinues actuating the shaped end in response to the controller receiving a door-open position detection signal.

24. The locking system of claim 23 wherein the motor actuates the shaped end to the unlocked position subsequent to the controller receiving the door-open position detection signal.

* * * * *